US005746845A

United States Patent [19]

Yoshida et al.

[11] Patent Number: 5,746,845

[45] Date of Patent: May 5, 1998

[54] METHOD FOR MANUFACTURING HIGH-STRENGTH MEMBER OF PRECIPITATION HARDENING MARTENSITIC STAINLESS STEEL

[75] Inventors: Hiroaki Yoshida, Tokai; Sachihiro Isogawa, Nagoya, both of Japan

[73] Assignee: Daido Tokushuko Kabushiki Kaisha, Nagoya, Japan

[21] Appl. No.: 534,308

[22] Filed: Sep. 27, 1995

[30] Foreign Application Priority Data

Sep. 30, 1994 [JP] Japan ..... 6-261018

[51] Int. Cl.[6] ..... C21D 8/00

[52] U.S. Cl. ..... 148/587; 148/608

[58] Field of Search ..... 148/587, 608

[56] References Cited

U.S. PATENT DOCUMENTS 4,042,421 8/1977 Van Den Sype et al. ..... 148/608

FOREIGN PATENT DOCUMENTS 404280918 10/1992 Japan ..... 148/608

*Primary Examiner*—Deborah Yee

*Attorney, Agent, or Firm*—Sughrue, Mion, Zinn, Macpeak & Seas

[57] ABSTRACT

A high-strength member of precipitation hardening martensitic steel is manufactured through the steps of heating precipitation hardening martensitic stainless steel at an austenitizing temperature, performing the first plastic working at a temperature between 200° C. and 700° C. so as to leave a part of austenite as retained austenite at the time of cooling the steel at Ms point or below thereafter, cooling the steel at the temperature not higher than Ms point, performing the next plastic working at a temperature not higher than As point so as to transform the retained austenite into martensite, and performing age hardening treatment at a temperature between not lower than 370° C. and lower than 480° C.

8 Claims, 5 Drawing Sheets

(390°C × 4h AGING)

(410°C × 4h AGING)

METHOD FOR MANUFACTURING HIGH-STRENGTH MEMBER OF PRECIPITATION HARDENING MARTENSITIC STAINLESS STEEL

BACKGROUND OF THE INVENTION

1. Field of the Invention

This invention relates to a method for manufacturing a high-strength member made of precipitation hardening martensitic stainless steel represented by SUS 630 (corresponding to ASTM 630) and SUS 631 (corresponding to ASTM 631) defined by JIS G 4303.

2. Description of the Prior Art

The precipitation hardening martensitic stainless steel is an alloy steel enabled to increase the strength by precipitating fine intermetallic compounds from a martensitic matrix.

However, for example, age hardening treated SUS 630 has a hardness of 450 Hv or so at the most in a case of JIS H 900 treatment defined by JIS G 4303 (quenching from 1020°–1060° C., and cooling in air after maintaining at 470°–490° C.), therefore it is not possible to say that the strength of the steel attains a satisfactory high level.

On the other side, a large quantity of retained austenite is present in SUS 631 steel even after the solution treatment, therefore the age hardening treatment is carried out after transforming the retained austenite into martensite by subzero treatment for a long time of 8 hours at −70° C. or cold working.

It is known that hardness after the age hardening treatment increases drastically in a case of performing the cold working on SUS 631 steel after the solution treatment.

Practically, the hardness of SUS 631 steel attains 400 Hv or above through the cold working. Accordingly, in a case of manufacturing a bolt, for example, it is not possible actually to form threads of the bolt by rolling after forming an outline of the bolt through the cold working.

Namely, it was not possible practically to form complicated-shaped components through plastic working and secure high-strength of 500 Hv or above by the age hardening treatment after the plastic working in the case of manufacturing the high-strength member of the precipitation hardening martensitic stainless steel in the past.

SUMMARY OF THE INVENTION

This invention is made with the object of solving the aforementioned problem of the prior art.

That is, the manufacturing method according to this invention is characterized by comprising heating precipitation hardening martensitic stainless steel at an austenitizing temperature, performing first plastic working for the stainless steel at a temperature between 200° C. and 700° C., cooling the stainless steel at a temperature not higher than Ms point, performing second plastic working for the stainless steel at a temperature not higher than As point, and conducting age hardening treatment for the stainless steel at a temperature not lower than 370° C. and lower than 480° C.

In this invention, As point means the temperature at which the martensitic structure will start to be transformed into austenite by heating.

In an embodiment of the manufacturing method according to this invention, it is preferable to perform the first plastic working on condition so that austenite may be retained partially without transformation when the stainless steel is cooled at the temperature not higher than Ms point and to perform the second plastic working on condition so that the whole retained austenite may be transformed into deformation induced martensite substantially.

In the other embodiment of the manufacturing method according to this invention, it is further preferable to perform the first plastic working on condition so that 3 to 20% of austenite may be retained without transformation when the stainless steel is cooled at the temperature not higher than Ms point.

In the other embodiment of the manufacturing method according to this invention, it is further preferable to perform the first plastic working at reduction in area of 30 to 75%.

In another embodiment of the manufacturing method according to this invention, it is desirable to apply this method to production of a screw bolt, and preferable to forge a head and a shank of the bolt from bar steel at the first plastic working and to roll a screw thread of the shank at the second plastic working.

DETAILED DESCRIPTION OF THE INVENTION

In the manufacturing method according to this invention for the high-strength member, the first plastic working is carried out for precipitation hardening martensitic stainless steel at a temperature between 200° C. and 700° C. after heating the steel at an austenitizing temperature.

In this state, the material steel has the austenitic structure entirely and is soft, therefore it is possible to be worked easily into a complicated shape.

Figure 1:
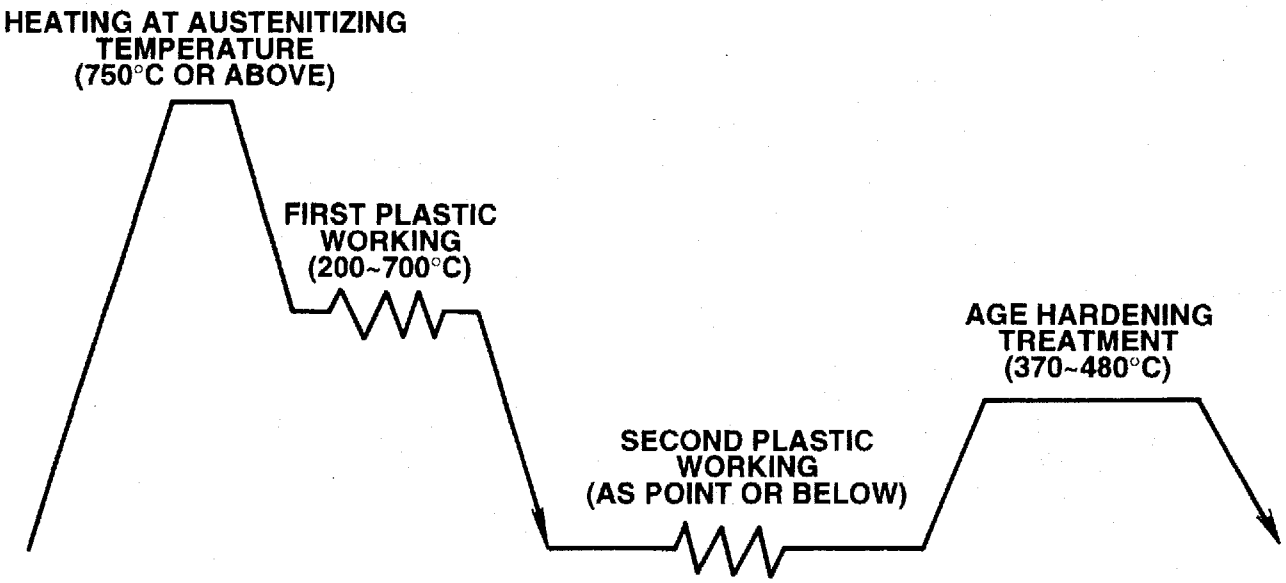
FIG. 1 is a flow diagram illustrating production steps of the method for manufacturing the high-strength member of precipitation hardening martensitic stainless steel according to this invention.

In the method according to this invention, the plastically worked steel is cooled at a temperature not higher than Ms point, subsequently the second plastic working is carried out for the steel at a temperature not higher than As point, and the age hardening treatment is carried out for the steel at a temperature not lower than 370° C. and lower than 480° C. FIG. 1 is a flow diagram showing production steps of the manufacturing method according to this invention.

In this invention, it is possible to easily perform plastic working such as thread rolling or so since the hardness of the material steel does not become so hard at the time of the second plastic working at the temperature not higher than As point.

Furthermore, according to this invention, it is possible to improve strength of the material steel by the age hardening treatment at a low temperature not lower than 370° C. and lower than 480° C. This is based on a lowering phenomenon of peak aging temperature owing to the residual strain caused by the plastic working on the martensitic structure.

In the method according to this invention, it is desirable to control working temperature and the degree of deformation at the time of the first plastic working at the temperature between 200° C. and 700° C. so that a part of the austenitic structure of the material steel may be left without transformation as retained austenite in the martensitic structure when the material steel is cooled at the temperature not higher than Ms point thereafter.

In such the case of performing the first plastic working on condition that the austenite is left as retained austenite at the time of cooling to the temperature not higher than Ms point, it is not only possible to transform the retained austenite into the martensitic structure owing to deformation induced transformation when the second plastic working is carried out at the temperature not higher than As point thereafter, but also possible to obtain a high-strength member through the subsequent age hardening treatment.

Namely, the member of higher strength can be obtained through the age hardening treatment of the martensitic structure mixed with the deformation induced martensite as compared with that obtained through the age hardening treatment of simple martensitic structure.

This effect can be obtained by utilizing work hardening of the martensitic structure and work hardening accompanied with the transformation into martensite from austenite, and it is utilized that the work hardening is very remarkable when the retained austenite is transformed into the martensitic structure by the deformation induced transformation.

According to this invention, it is possible to obtain the member of high strength which has never been obtained through the conventional manufacturing method.

Next, explanation will be given concretely about the regulation of the quantity of retained austenite by controlling the work temperature and the degree of the deformation at the first plastic working at the temperature between 200° C. and 700° C., the improvement in the hardness based on the deformation induced martensitic transformation of the retained austenite by the subsequent second plastic working at As point or below and the age hardening treatment, and the improvement in the hardness responsive to the quantity of the retained austenite.

Figure 2:
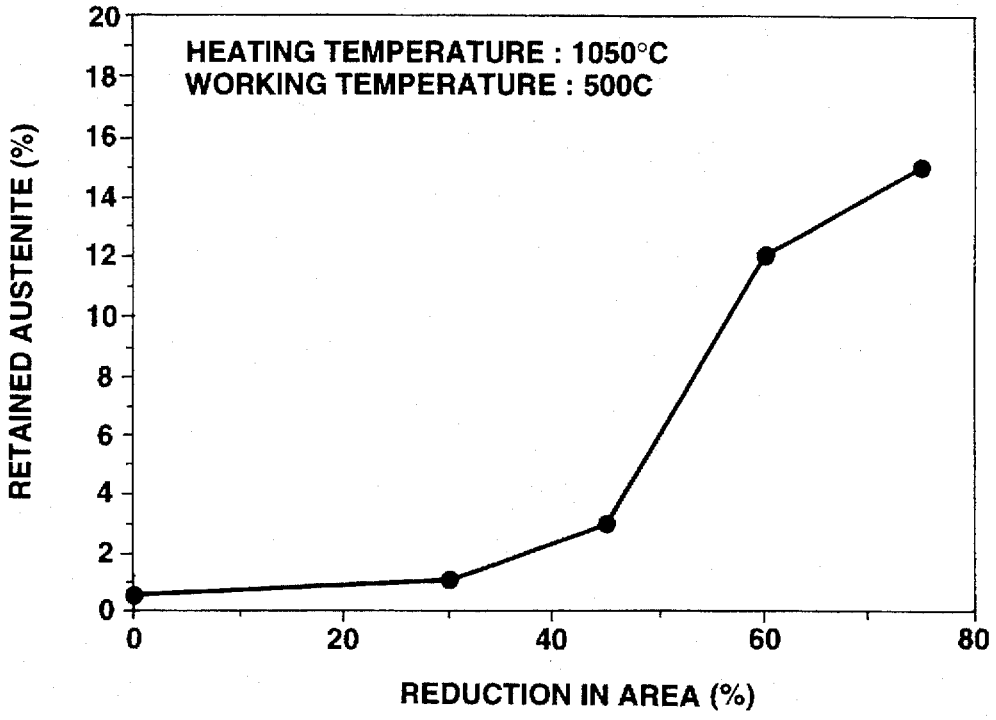
FIG. 2 is a graph illustrating relationship between reduction in area and quantity of retained austenite at room temperature at the time of performing plastic working for SUS 630 steel of austenitic structure.

FIG. 2 shows the quantity of the retained austenite in SUS 630 steel cooled to room temperature by air cooling in the case of performing forward extrusion (reduction in area : 30, 45, 60 and 75%) at 500° C. after heating at 1050° C. and cooling in air.

From the results shown in FIG. 2, it is seen that the quantity of the retained austenite increases according as the degree of the deformation (reduction in area) in the austenite range increases.

Figure 3:
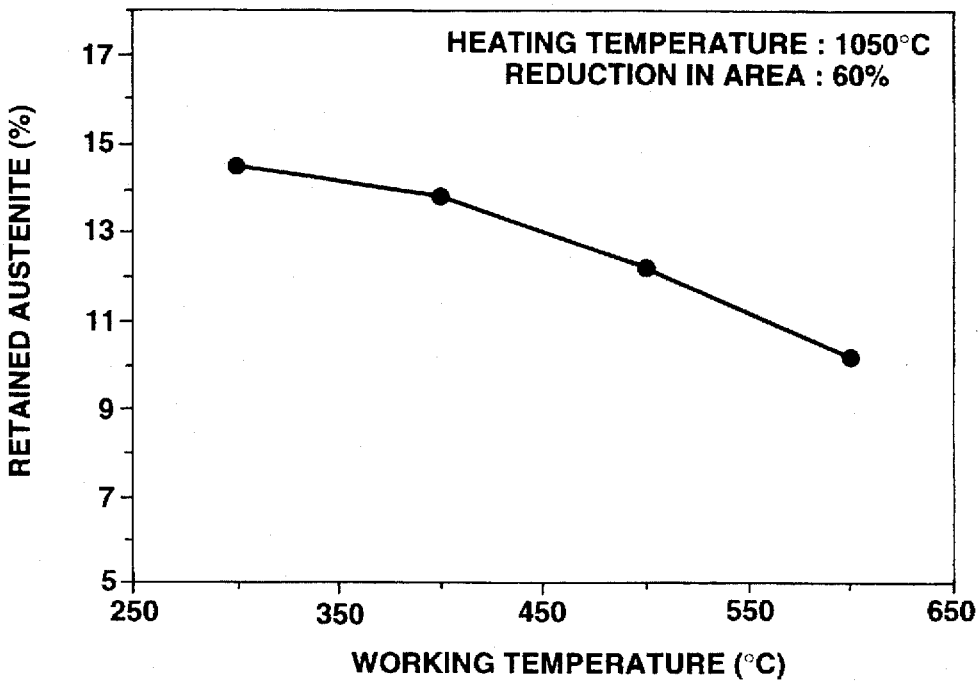
FIG. 3 is a graph illustrating relationship between working temperature and quantity of retained austenite at room temperature at the time of performing plastic working for SUS 630 steel of austenitic structure.

FIG. 3 shows results of measuring the quantity of the retained austenite in SUS 630 steel cooled to room temperature by air cooling in the case of performing forward extrusion (reduction in area : 60%) at 300°–600° C. after heating at 1050° C. and cooling in air.

From the results shown in FIG. 3, it is seen that the quantity of the retained austenite is inclined to increase according as the working temperature decreases.

In this manner, the retained austenite increases easily in quantity by the plastic deformation in the austenite range. This tendency becomes remarkable with the increase of the degree of the deformation and the reduction of the working temperature, accordingly it is possible to regulate the retained austenite into the optional quantity according to need by controlling the degree of the deformation and the working temperature.

Generally, in the precipitation hardening martensitic stainless steel, precipitates come out from the martensitic structure by the age hardening treatment, therefore the strength after the age hardening treatment deteriorates if the retained austenite exists in the structure before the age hardening treatment.

However, in the method according to this invention, the retained austenite is transformed into the martensitic structure by performing the second plastic working at As point or below in succession to the first plastic working at 200°–700° C., therefore the strength after the age hardening treatment increases.

Figure 4:
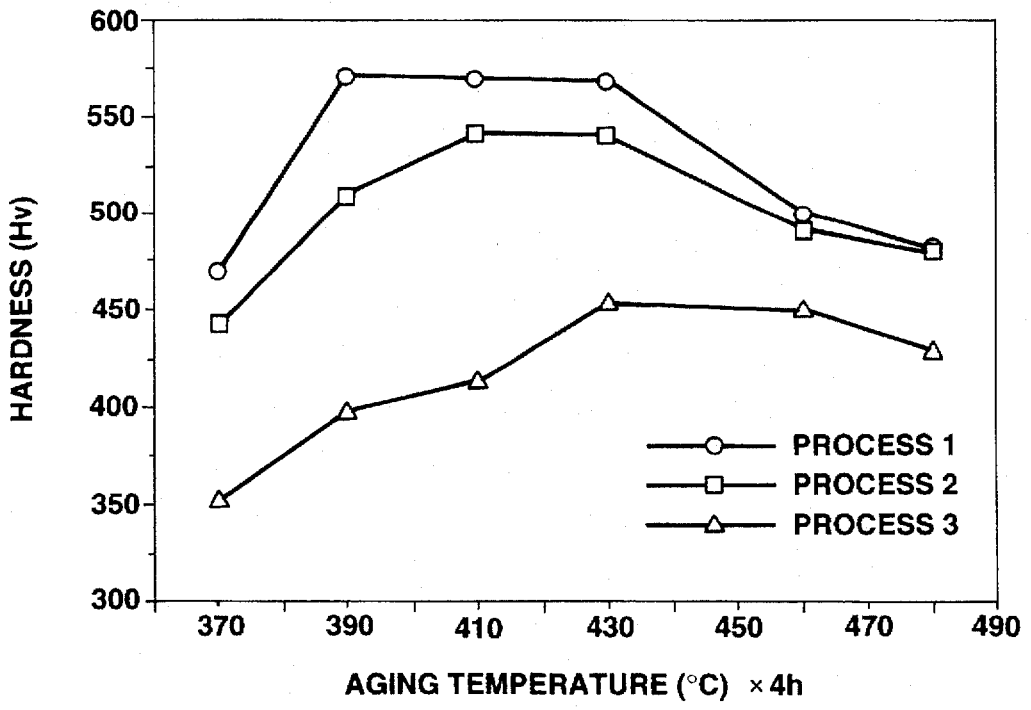
FIG. 4 is a graph illustrating relationship between aging temperature and hardness together with comparative examples in a case of performing plastic working and age hardening treatment for SUS 630 steel according to this invention.

FIG. 4 is a graph illustrating results of Vicker's hardness tests in order to clarify the effect of this invention.

In the graph shown in FIG. 4, data are shown with mark ○ as process 1, which are obtained in a case of performing forward extrusion (reduction in area : 60%) on SUS 630 steel at 500° C. (with corresponds to the first plastic working) after heating the steel at 1050° C., and subsequently performing the age treatment at respective temperature after compressive deformation (upsetting ratio : 75%) at room temperature (which corresponds to the second plastic working). The other data are shown with mark □ as process 2 in FIG. 4, which are obtained in a case of performing the age hardening treatment at the respective temperature after the compressive deformation (upsetting ratio : 75%) of the solution treated SUS 630 steel (1050° C.×4 hours/oil quenching). Furthermore, data are shown with mark Δ as process 3, which are obtained in a case of performing the age hardening treatment at the respective temperature on the solution treated SUS 630 steel (1050° C.×4 hours/oil quenching) without performing any plastic working.

Additionally, in the age hardening treatment in the aforementioned process 1 to 3, SUS 630 steel is cooled in air after maintaining at the respective temperature (370°–480° C.) for 4 hours.

From the results shown in FIG. 4, it is confirmed that the hardness of the steel treated through process 1 is higher than that of the steel treated through the other process.

Furthermore, it is seen that it is effective especially in a case of performing the age hardening treatment at low temperature of 430° C. or below.

Figure 5:
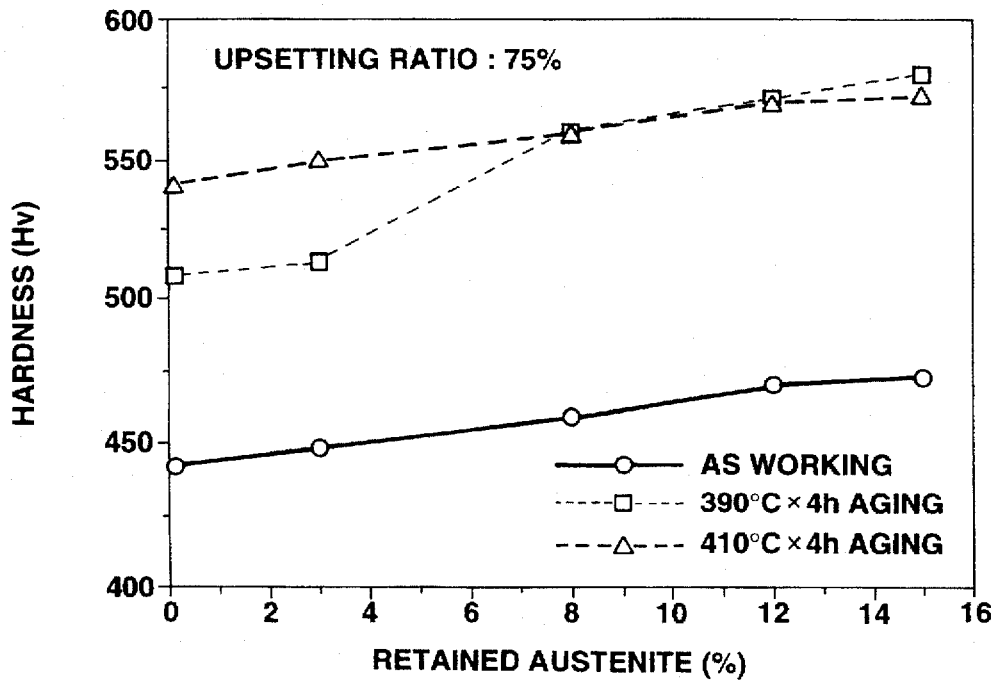
FIG. 5 is a graph illustrating relationship between quantity of retained austenite at room temperature before the age hardening treatment and hardness obtained through the age hardening treatment together with a comparative example in a case of performing plastic working and the age hardening treatment for SUS 630 steel according to this invention.

In FIG. 5, relationship is shown between the quantity of the retained austenite and the hardness obtained by the age hardening treatment after the cold working. In the graph shown in FIG. 5, data are shown with marks □ and Δ, which are obtained by performing forward extrusion on SUS 630 steel at 500° C. after heating the steel at 1050° C., and subsequently performing the age hardening treatment (390°

C. and 410° C.×4 hours/air cooling) after compressive deformation (upsetting ratio : 75%) at room temperature.

In this time, the quantity of the retained austenite is controlled by changing the reduction in area at the time of forward extrusion at 500° C. according to the results obtained in FIG. 2. Additionally, the material steel with austenite of 0% shown in FIG. 5 represents the solution treated steel.

From the results shown in FIG. 5, it is seen that the hardness after the age hardening treatment increases according as the quantity of the retained austenite increases on the ground that the degree of work hardening obtained in a case of working the retained austenite is higher than that obtained by working the martensite. Furthermore, as is apparent from comparison with data shown with mark ○, which represent the hardness before the age hardening treatment, the structure is further hardened according to the precipitation hardening without losing the work hardening by combining the aging treatment at a low temperature.

By the way, the quantity of the retained austenite is reduced to not higher than 0.5% by the compressive deformation at room temperature, and it is confirmed that the whole retained austenite is substantially transformed into the martensitic structure by the deformation induced transformation.

In the method according to this invention, it is preferable to perform the first plastic working (200°–700° C.) so as to leave austenite of 3 to 20% without transformation as the retained austenite at the time of subsequent cooling at a temperature not higher than Ms point.

Namely, if the retained austenite is less than 3%, it is difficult to sufficiently improve the strength through the subsequent plastic working at As point or below (second plastic working) and successive precipitation hardening treatment, and it becomes difficult to transform all the retained austenite into the martensitic structure through the cold working when the retained austenite is more than 20%.

Furthermore, it is further preferable to control the quantity of the retained austenite in a range of 6 to 18%.

In the method according to this invention, it is preferable to perform the plastic working at the degree of the deformation of reduction in area of 30 to 75% at the time of the first plastic working at a temperature between 200° C. and 700° C. It is possible to control the retained austenite in the desirable range by performing the plastic working in this degree of the deformation.

Also in the method according to this invention, it is preferable to perform the age hardening treatment successive to the second plastic working (As point or below) at a low temperature between 370° C. and 430° C. It is possible to increase the hardness (strength) very effectively by performing the age hardening treatment at such a low temperature.

The method according to this invention is also suitable to be applied to the production of a screw bolt.

In the case of manufacturing the screw bolt, it is required the plastic working in two steps which consists of the first step for forming an intermediate product having a bolt head with a large diameter and a shank to be formed with a screw thread from bar steel, and the second step for rolling the screw thread on a peripheral face of the shank. According to this invention, it is possible to perform the working on the material steel (bar steel) in the first step accompanied with large plastic deformation at a state in which the hardness of the material steel is not so high. Furthermore, it is possible to provide the screw bolt with toughness according to this invention by hardening the surface layer of the screw thread selectively and controlling the hardness at the center of the screw bolt to some degree, therefore it is possible to improve the properties of the screw bolt very effectively.

EXAMPLE

Next, the invention will be explained in detail with respect to the example in order to make clear a special merit of this invention.

Figure 6A:
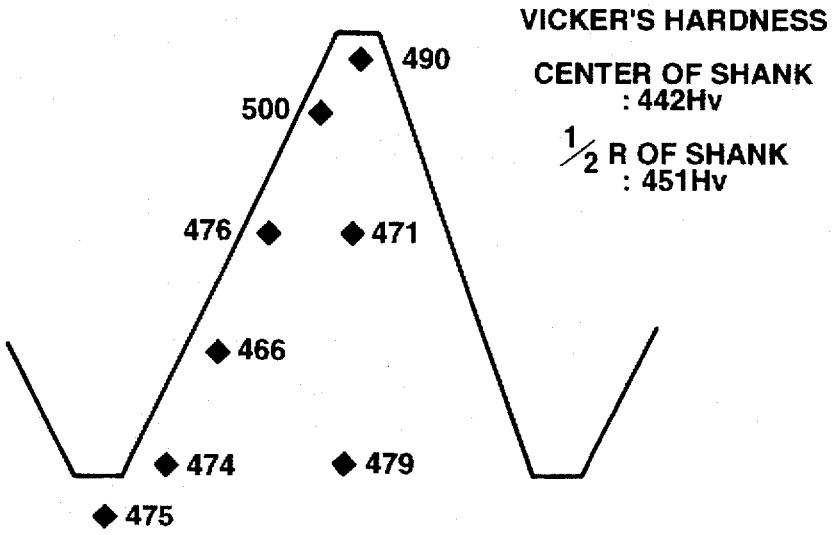
FIGS. 6A and 6B are graphs illustrating hardness distribution at screw treads of bolts obtained through an embodiment of the manufacturing method according to this invention.
Figure 6B:
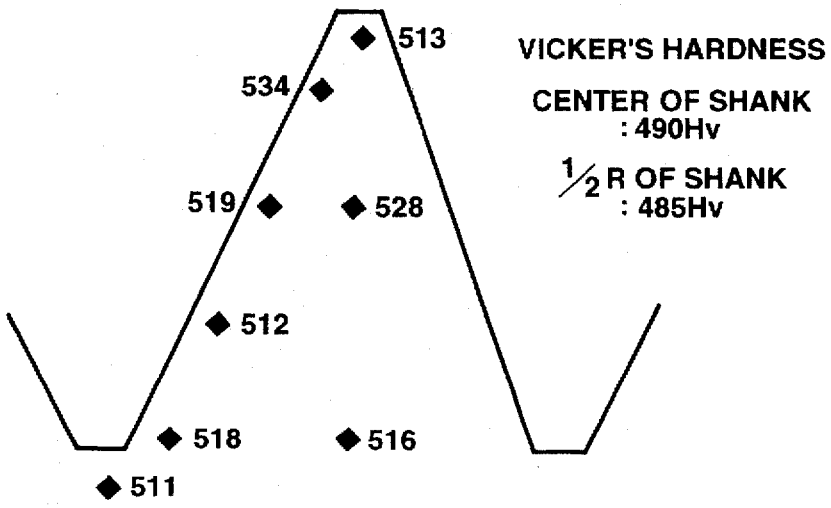

In FIGS. 6A and 6B, hardness distribution is shown at thread portion of a M8 screw cap (screw bolt) manufactured from SUS 630 steel through the following method according to this invention.

Figure 7A:
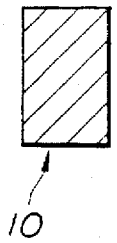
FIGS. 7A to 7G are axial sectional views illustrating forging steps of the bolts shown in FIGS. 6A and 6B.
Figure 7B:
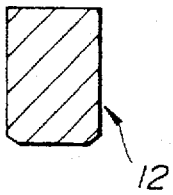
Figure 7C:
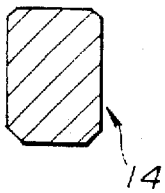
Figure 7D:
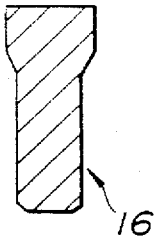
Figure 7E:
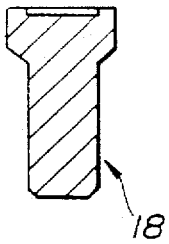
Figure 7F:
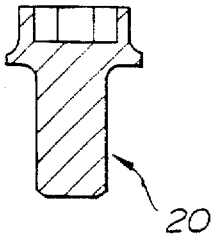
Figure 7G:
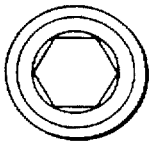

First of all SUS 630 steel is heated at 1050° C. and cooled to a temperature of 500° C. in air, and then forging is carried out at 500° C. according to steps shown in FIGS. 7A to 7G. Namely, an intermediate product 20 shown in FIGS. 7E and 7G is formed through intermediate forms 12, 14, 16 and 18 shown in FIGS. 7B to 7E by performing the forging in five steps on the bar steel of SUS 630 shown in FIG. 7A having the initial form 10. In the intermediate product 20, reduction in area at a shank corresponds to 51% approximately. The intermediate product 20 is cooled again to room temperature in air after this.

Subsequently, the intermediate product 20 is subjected to thread rolling at room temperature and the age hardening treatment is carried out by cooling in air after maintaining at 390° C. and 410° C. for 4 hours in order to improve the strength of a thread face.

FIG. 6 shows measured points of the hardness on a section of the threaded portion of the screw cap and the measured value of the hardness at the respective measured points.

From the results shown in FIGS. 6A and 6B, it is confirmed that the hardness at the cold-worked portion (threaded portion) is improved sufficiently as compared with the hardness at the center of the screw cap.

According to this invention, therefore, the manufacturing process is established for producing a high-strength member of which hardness is high only at the surface and controlled to some degree at the center so as to be provided with toughness, for example.

Although the present invention has been explained concerning the preferred example, this invention is not limited to the aforementioned example and it is possible to practice the invention in various forms without departing from the sprit and scope of this invention. Namely, this invention is possible to be applied also to other precipitation hardening martensitic stainless steels including SUS 631 steel, for example.

As mentioned above, according to this invention, it is possible to form even a complicated-shaped member very easily in the case of manufacturing the high-strength member made of precipitation hardening martensitic steel, and possible to obtain the member of high strength which has been never obtained through the conventional method by the subsequent age hardening treatment.

What is claimed is:

1. A method for manufacturing a high-strength member which comprises the steps of:

heating precipitation hardening martensitic stainless steel at an austenitizing temperature:

performing first plastic working for said stainless steel at a temperature between 200° C. and 700° C.;

cooling the stainless steel at a temperature not higher than Ms point;

performing second plastic working for the stainless steel at a temperature not higher than As point; and conducting age hardening treatment for said stainless steel at a temperature between not lower than 370° C. and lower than 480° C.

2. A method for manufacturing a high-strength member as set forth in claim 1, wherein said first plastic working is carried out on condition so that austenite may be retained partially without transformation when the stainless steel is cooled at the temperature not higher than Ms point, and said second plastic working is carried out on condition so that the whole retained austenite may be transformed into deformation induced martensite substantially.

3. A method for manufacturing a high-strength member as set forth in claim 2, wherein said first plastic working is carried out on condition so that 3 to 20% of austenite may be retained without transformation when the stainless steel is cooled at the temperature not higher than Ms point.

4. A method for manufacturing a high-strength member as set forth in claim 3, wherein said first plastic working is carried out at reduction in area of 30 to 75%.

5. A method for manufacturing a high-strength member as set forth in claim 1, wherein said high-strength member is a screw bolt, a head and a shank of said screw bolt are forged from bar steel at the first plastic working, and a screw thread of said shank are form rolled at the second plastic working.

6. A method for manufacturing a high-strength member as set forth in claim 2, wherein said high-strength member is a screw bolt, a head and a shank of said screw bolt are forged from bar steel at the first plastic working, and a screw thread of said shank are form rolled at the second plastic working.

7. A method for manufacturing a high-strength member as set forth in claim 3, wherein said high-strength member is a screw bolt, a head and a shank of said screw bolt are forged from bar steel at the first plastic working, and a screw thread of said shank are form rolled at the second plastic working.

8. A method for manufacturing a high-strength member as set forth in claim 4, wherein said high-strength member is a screw bolt, a head and a shank of said screw bolt are forged from bar steel at the first plastic working, and a screw thread of said shank are form rolled at the second plastic working.

* * * * *